US008402807B2

(12) United States Patent
Zhou et al.

(10) Patent No.: US 8,402,807 B2
(45) Date of Patent: Mar. 26, 2013

(54) BLIND-RIVET GUN

(75) Inventors: Gui-Chu Zhou, Shenzhen (CN); Zhao-Yan Yang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 60 days.

(21) Appl. No.: 13/159,586

(22) Filed: Jun. 14, 2011

(65) Prior Publication Data

US 2012/0144636 A1 Jun. 14, 2012

(51) Int. Cl.
*B23P 19/00* (2006.01)
*B23Q 17/00* (2006.01)

(52) U.S. Cl. ..... 72/391.6; 72/453.17; 29/243.53; 29/243.523; 29/243.525

(58) Field of Classification Search ..... 72/391.4, 72/391.6, 453.17; 29/243.523, 243.524, 29/243.525, 243.53
See application file for complete search history.

(56) References Cited

U.S. PATENT DOCUMENTS

| | | | | | |
|---|---|---|---|---|---|
| 3,367,166 | A * | 2/1968 | Newton et al. | ..... | 72/453.17 |
| 4,062,217 | A * | 12/1977 | Ebbert et al. | ..... | 29/243.525 |
| 4,116,036 | A * | 9/1978 | Sheffield et al. | ..... | 29/243.525 |
| 4,903,522 | A * | 2/1990 | Miller | ..... | 29/243.525 |
| 5,383,262 | A * | 1/1995 | Brown | ..... | 29/243.525 |
| 5,661,887 | A * | 9/1997 | Byrne et al. | ..... | 29/243.525 |
| 6,347,449 | B1 * | 2/2002 | Calkins et al. | ..... | 29/701 |
| 7,024,742 | B2 * | 4/2006 | Woyciesjes et al. | ..... | 29/243.53 |
| 7,024,746 | B2 * | 4/2006 | Weeks et al. | ..... | 72/391.4 |

* cited by examiner

*Primary Examiner* — David B Jones
(74) *Attorney, Agent, or Firm* — Altis Law Group, Inc.

(57) ABSTRACT

A blind-rivet gun includes a gun header, a cylinder, a piston, and a tube. The cylinder is separated from the gun header. The piston includes a piston header. The piston header and an inner surface of the cylinder form a seal to divide the cylinder into a first air chamber and a second air chamber. The cylinder includes a first gas hole and a second gas hole. The first gas hole is connected to the first air chamber, and the second gas hole is connected to the second air chamber. The piston is adapted to slide in the cylinder to generate inner high pressure gas by alternatively supplying outer high pressure gas to the first gas hole or the second gas hole. The tube is connected to the gun header and the cylinder. The tube transmits inner high pressure from the cylinder to the gun header.

10 Claims, 3 Drawing Sheets

BLIND-RIVET GUN

BACKGROUND

1. Technical Field

The present disclosure relates to mechanical tools, and particularly to a blind rivet gun.

2. Description of Related Art

A blind-rivet gun for setting blind-rivets is known and is generally used in the following way. A blind-rivet having an internal thread in the inner periphery of a flanged sleeve is inserted and fitted in, for example, mounting holes in two panels connected to each other, and a screw mandrel of the blind-rivet gun is threadedly connected to blind-rivets. The blind rivet gun is often equipped with a hydraulic pressure apparatus which provides hydraulic pressure. While the hydraulic pressure apparatus presses the flanged sleeve of the blind-rivet to the lateral sides of the panel mounting holes, the screw mandrel is retracted toward the inner side of the gun body to outwardly expand and deform the flanged sleeve. Thus, the two panels are secured to each other as pressed and held between the deformed sleeve and the flange. However, the hydraulic pressure apparatus is often combined with the blind-rivet gun, which is too heavy to conveniently manipulate.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
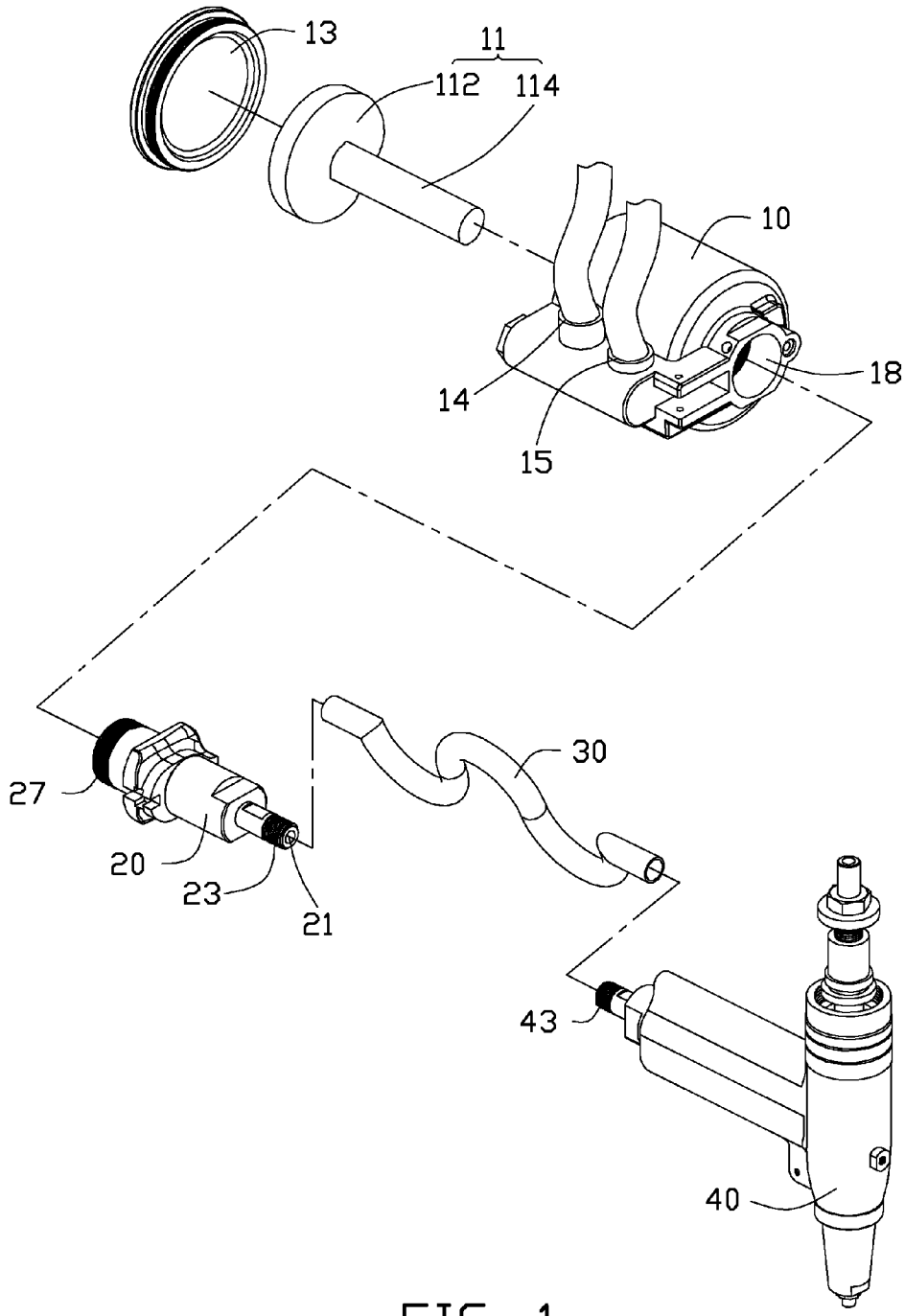
FIG. 1 is an exploded and isometric view of an embodiment of a blind-rivet gun.
Figure 2:
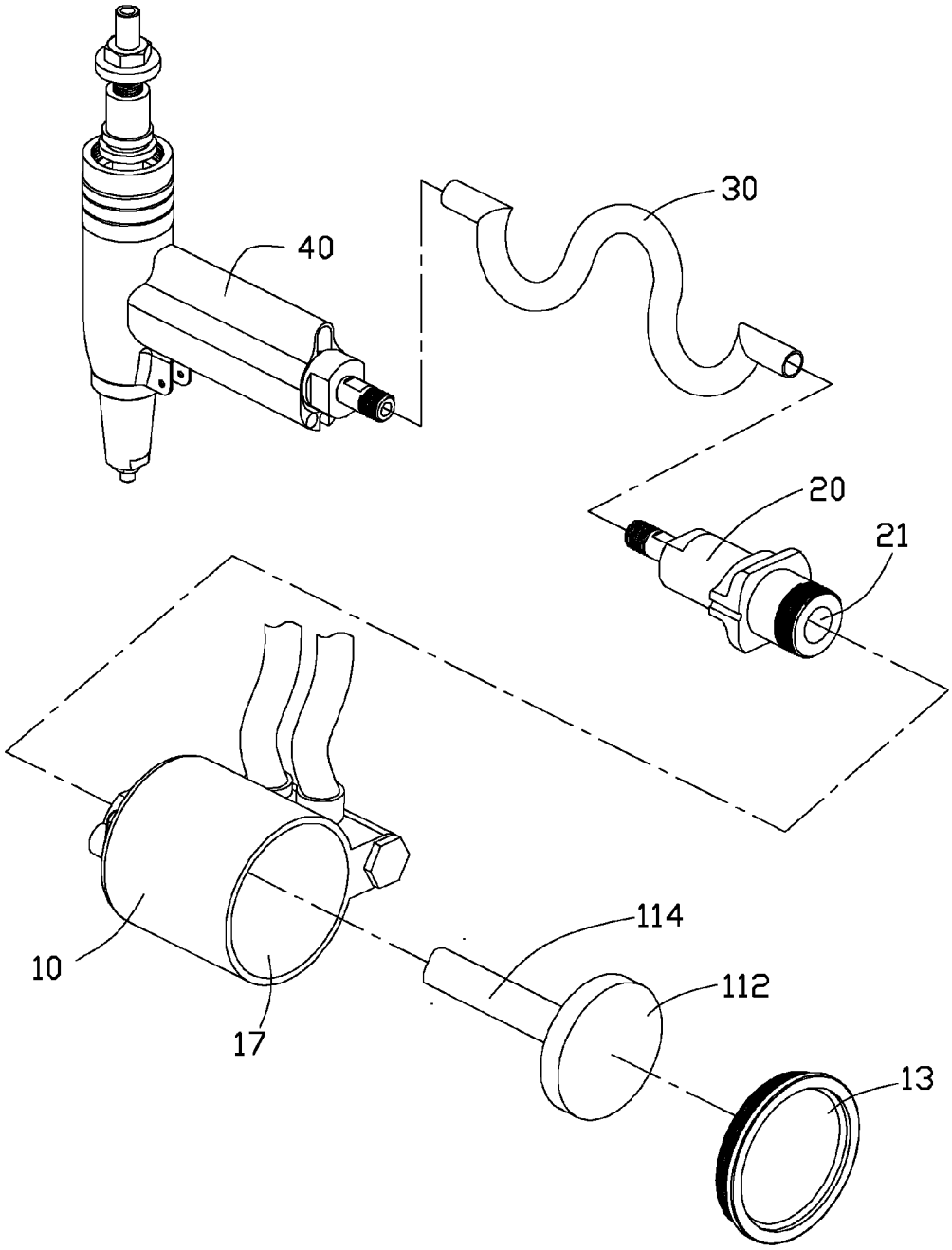
FIG. 2 is similar to FIG. 1, but viewed from another aspect.

Referring to FIGS. 1 and 2, a blind-rivet gun in accordance with an embodiment, includes a cylinder 10, a supercharger 20, a tube 30, and a gun header 40.

The cylinder 10 is hollow and contains a reciprocating piston 11. The cylinder 10 includes a first gas hole 14 and a second gas hole 15. The first gas hole 14 and the second gas hole 15 are intercommunicated with an inner space of the cylinder 10. A first end of the cylinder 10 has an engaging hole 18. A second end of the cylinder 10 has an opening 17. A cover 13 can be mounted on the second end of the cylinder 10 to close the opening 17.

The piston 11 includes a piston header 112 and a piston rod 114 connected to the piston header 112. The size of the piston header 112 is about the same as that of a cross section of the inner space of the cylinder 10. The piston rod 114 can slide in the engaging hole 18 of the cylinder 10.

The supercharger 20 includes an engaging end 27 and a first mounting end 23. A through hole 21 is defined between the engaging end 27 and the first mounting end 23. A size of the through hole 21 gradually becomes smaller from the engaging end 27 to the first mounting end 23.

The tube 30 is flexible and can be bent in any direction.

The gun header 40 can eject blind-rivets therefrom. The gun header 40 includes a second mounting end 43.

Figure 3:
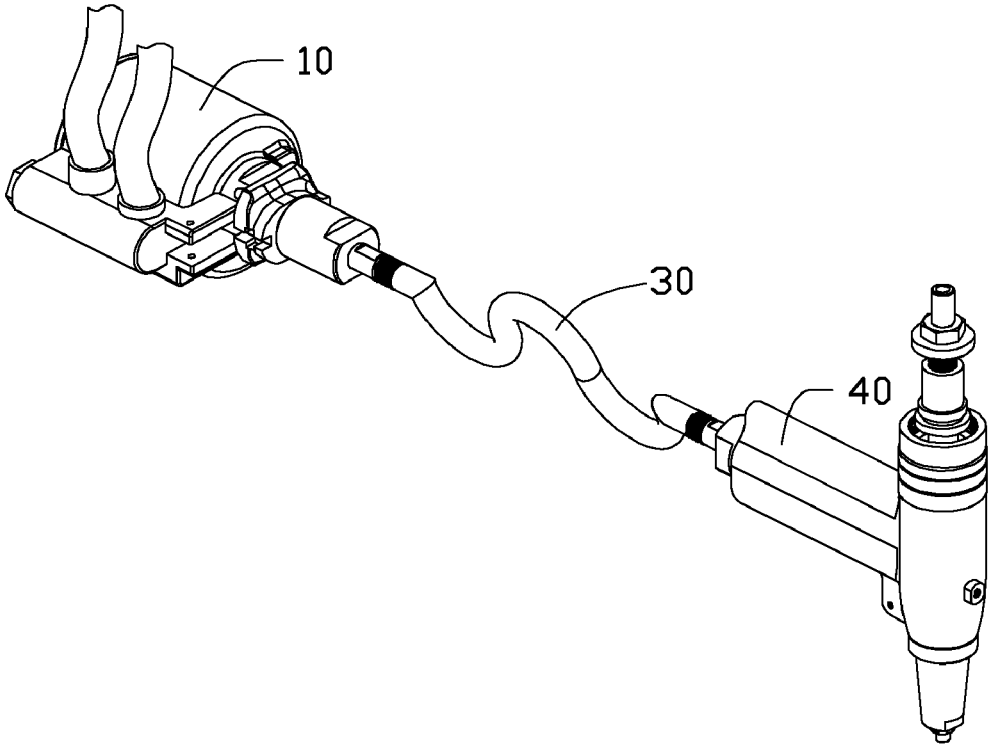
FIG. 3 is an assembly view of the blind-rivet gun of FIG. 1.

Referring to FIGS. 1 to 3, in assembly of the blind-rivet gun, the piston 11 is put into the inner space of the cylinder 10. The piston header 112 can slide on an inner surface of the cylinder 10. The piston header 112 forms a seal with the inner surface of the cylinder 10, dividing the inner space of the cylinder 10 into a first air chamber and a second air chamber (not shown). The first gas hole 14 is intercommunicated with the first air chamber. The second gas hole 15 is intercommunicated with the second air chamber. The piston rod 114 is inserted in the engaging hole 18.

The engaging end 27 is secured in the engaging hole 18. At last, a first end of the tube 30 is mounted on the first mounting end 23. A second end of the tube 30 is mounted on the second mounting end 43. Therefore, the blind-rivet gun is assembled.

When using the blind-rivet gun, outer high pressure gas is supplied in the first gas hole 14. The piston header 112 is pushed. The piston 11 slides in the inner space of the cylinder 10. The piston rod 114 is inserted in the through hole 21 of the supercharger 20 to generate inner high pressure, which is supplied to the gun header 40 via the tube 30. The gun header 40 then ejects blind-rivets. Then, gas under high pressure is supplied in the second gas hole 15. The piston 11 is pushed to slide back to an original piston.

In the blind-rivet gun, the gun header 40 is connected to the supercharger 20 and the cylinder 10 via the tube 30. The supercharger 20 and the cylinder 10 do not need to move together with the gun header 40. The gun header 40 is convenient to use.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A blind-rivet gun, comprising:

a gun header;

a cylinder separated from the gun header;

a piston slidably mounted in the cylinder, the piston comprising a piston header, the piston header and an inner surface of the cylinder form a seal to divide the cylinder into a first air chamber and a second air chamber; the cylinder comprising a first gas hole and a second gas hole, the first gas hole connected to the first air chamber, and the second gas hole connected to the second air chamber, the piston adapted to slide in the cylinder to generate inner high pressure gas by alternatively supplying outer high pressure gas to the first gas hole or the second gas hole;

a tube connected to the gun header and the cylinder, wherein the tube is adapted to transmit inner high pressure gas generated by the cylinder to the gun header; and a supercharger connected between the tube and the cylinder, wherein the piston comprises a piston rod; the supercharger comprises a through hole, the piston rod is adapted to insert in the through hole to generate inner high pressure gas.

2. The blind-rivet gun of claim 1, wherein the supercharger comprises an engaging end and a first mounting end, the engaging end is connected to the cylinder, and the first mounting end is connected to the tube.

3. The blind-rivet gun of claim 2, wherein the through hole is defined between the engaging end and the first mounting end, a size of the through hole gradually decreases from the engaging end to the first mounting end.

4. The blind-rivet gun of claim 3, wherein the cylinder comprises an engaging hole which is connected to the through hole.

5. The blind-rivet gun of claim 1, wherein the tube is flexible and is adapted to be bent in any direction.

6. A blind-rivet gun, comprising:

a cylinder comprising a piston slidably mounted therein, the piston comprising a piston rod;

a supercharger comprising an engaging end and a first mounting end, a through hole defined between the engaging end the first mounting end, a size of the through hole gradually decreases from the engaging end to the first mounting end, and the piston rod is adapted to insert in the through hole from the engaging end to generate high pressure gas;

a gun header comprising a second mounting end; and a tube mounted between the first mounting end and the second mounting end, the tube adapted to transmit high pressure gas to the gun header from the supercharger.

7. The blind-rivet gun of claim 6, wherein the engaging end is connected to the cylinder.

8. The blind-rivet gun of claim 7, wherein the cylinder comprises an engaging hole which is connected to the through hole.

9. The blind-rivet gun of claim 6, wherein the piston comprises a piston header, the piston header and an inner surface of the cylinder form a seal to divide the cylinder into a first air chamber and a second air chamber; and the cylinder comprises a first gas hole and a second gas hole, the first gas hole is connected to the first air chamber, and the second gas hole is connected to the second air chamber.

10. The blind-rivet gun of claim 6, wherein the tube is flexible and is adapted to be bent in any direction.

* * * * *